United States Patent [19]

Solberg et al.

[11] Patent Number: 4,660,628

[45] Date of Patent: Apr. 28, 1987

[54] HEAT EXCHANGER

[75] Inventors: Per Solberg, Rådalen; Jan Grønhaug, Ulset, both of Norway

[73] Assignee: Stord Bartz A/S, Bergen, Norway

[21] Appl. No.: 852,948

[22] PCT Filed: Jul. 29, 1985

[86] PCT No.: PCT/NO85/00045

§ 371 Date: Mar. 20, 1986

§ 102(e) Date: Mar. 20, 1986

[87] PCT Pub. No.: WO86/01284

PCT Pub. Date: Feb. 27, 1986

[51] Int. Cl.[4] ..... F28F 5/04

[52] U.S. Cl. ..... 165/92; 165/86; 165/168

[58] Field of Search ..... 165/86, 92, 168

[56] References Cited

U.S. PATENT DOCUMENTS

| | | | |
|---|---|---|---|
| 3,923,097 | 12/1975 | Hovad | 165/92 |
| 3,951,206 | 4/1976 | Williams et al. | 165/92 |
| 4,301,860 | 11/1981 | Pozzi | 165/92 X |

FOREIGN PATENT DOCUMENTS

| | | | |
|---|---|---|---|
| 2708270 | 8/1978 | Fed. Rep. of Germany | 165/168 |
| 1353594 | 1/1964 | France | 165/168 |
| 0053695 | 4/1980 | Japan | 165/92 |

*Primary Examiner*—Albert W. Davis, Jr.
*Assistant Examiner*—Randolph A. Smith
*Attorney, Agent, or Firm*—Kenyon & Kenyon

[57] ABSTRACT

A heat exchanger (10) for indirectly heating, drying and cooling materials comprises a hollow rotor (40) having an inlet (46) of heating and cooling medium and an outlet (47) of the medium or its condensate, a casing mounted on the hollow rotor, a plurality of disc-shaped base boards (20), a plurality of annular ducts (21, 23; 22, 24) projected from both side surfaces (11, 12) of the base boards (20), the duct forming a passage communicating with the inlet (46) and the outlet (47), arranged so as to be partly superposed sequentially on both front and back surfaces (11, 12) of the base board (20) from the inner peripheral edges to the outer peripheral edges of the base boards (20) in such a manner that partition plates for shielding the ducts (21, 23; 22, 24) being provided in the superposed positions.

18 Claims, 6 Drawing Figures

HEAT EXCHANGER

TECHNICAL FIELD

This invention relates to a heat exchanger for heating, drying or cooling a material and, more particularly, to a heat exchanger for indirectly heating or drying a material at low temperatures.

BACKGROUND ART

There have been, heretofore, two types of heat exchangers for drying moist tacky materials to supplement the disadvantages of a direct heating type. One heat exchanger is of a screw conveyor type which supplies heat medium to a hollow portion of a rotor and thermally exchanges materials while feeding by a spiral follow continuous blade provided on the outer periphery of the rotor a material toward a direction of a rotational shaft. The other heat exchanger is of a thermal disc type which aligns a number of hollow discs of triangular cross section on a rotor and thermally exchanges materials via heat medium supplied into the hollow discs.

The former screw conveyor type has such disadvantages as small thermal exchanging area per unit per unit volume of its housing and small treating capacity.

The latter thermal disc type has various disadvantages that hollow discs are excessively large to reduce the effective area for containing materials, the hollow discs of triangular cross section cannot effectively agitate nor feed the materials as the materials are moist and tacky like organic materials, and tend to adhere to the surfaces of the hollow discs, to stay as large lump between the discs. The materials are thus locally heated, resulting in a difficulty in efficient thermal exchange and in a deterioration of the quality of the materials. Further, air (remaining air, noncompressive gas in the discs) and drain (condensate) are not recovered by centrifugal force in the triangular space at the outer peripheral side in the rotating hollow discs but remain. Thus, the heat medium is not sufficiently supplied and thermal exchange is disturbed by the residue. Further, thermal conductivity decreases due to the materials adhered to the surface of the hollow discs and thus reduces the coefficient of thermal transmission. Consequently, heat medium of high pressure is supplied into the hollow discs. Thus, a number of posts must be welded fixedly in the hollow discs so as to meet the safety standard as a pressure vessel in strength due to the regulations of a boiler. Therefore, some portions of the outer peripheral edges of the hollow discs which are to contribute mostly to the heat exchange cannot transmit the heat and decreases the thermal efficiency. Further, the discs corrode in the portions which cannot transmit the heat, thereby eventually causing the heat medium to be externally leaked.

In order to eliminate the disadvantages of such a conventional heat exchanger, Japanese Patent Publication No. 41501/1977, (corresponding to U.S. Pat. No. 3,923,097, describes a heat exchanger in which annular ribs cut from plane sheets are attached to the outer periphery of a rotor, a spiral duct closed at the outer end is formed at one side of the rib, the interior of the duct is longitudinally divided to form reciprocating paths of the heat medium or heat medium and condensed water are recovered through passages formed radially of the ribs from the closed outer end of the duct to circulate in the duct.

However, the heat exchanger of this type still has the following drawbacks.

First, since the fixture of the rib formed from the plane sheet to the rotor is not welded fixedly to the outer periphery of the rotor through a wide gap at the lower ends of the disc like the conventional hollow disc, the strength of the rib is small.

Second, the heat medium and the condensed water from the closed end of the outer periphery of the spiral duct are intended to be unreasonably recovered from the outer peripheral end having high peripheral velocity to the rotor of the central direction against the centrifugal force due to the rotation of the rib, and air and drain cannot be sufficiently recovered. Thus, the heat medium must be supplied into the duct under as high pressure as possible.

Third, the formation of the spiral duct or of the ribs on the duct requires extremely complicated steps so as to maintain high accuracy and strength.

Fourth, the portions which do not transmit heat are produced at the closed end of the duct and at the outer periphery of the rib, and the portion which does not transmit heat is widely presented at the peripheral edge of the rib which mostly contribute to the heat exchange, resulting in a low thermal efficiency. Since corrosion occurs from the portion which does not transmit heat of the rib, the closed end of the duct is eventually corroded, thereby resulting in the leakage of the heat medium from the corroded portion.

DISCLOSURE OF THE INVENTION

The present invention has been made to eliminate the prior art disadvantages and an object thereof is to provide a heat exchanger adapted for the satety standards of pressure vessels in all countries in a structure to be fully automated in all manufacturing steps, capable of simultaneously sufficient agitating effect of materials, accurately feeding the material, efficiently thermally exchanging the materials, and drying the organic materials improper for drying at high temperature by low temperatures in a short time.

Briefly, the invention provides a heat exchanger which includes a hollow rotor having an inlet for a heat exchange medium and an outlet for the heat exchange medium or its condensate. In addition, a plurality of disc-shaped base boards are mounted along the rotor with each board having a plurality of concentric annular ductsmounted on the opposite sides thereof in partially overlapping relation. In addition, at least one pair of partitions is disposed in each duct in circumferentially spaced relation to divide each duct into a primary chamber and a secondary chamber while openings are provided in the base board to communicate one chamber of one duct with one chamber of an overlapping duct. The partitions and openings are arranged so as to define a flow path for the heat exchange medium from the primary chamber of the innermost duct sequentially through the primary chambers of the remaining ducts and then through the secondary chambers of these ducts to the secondary chamber of the innermost duct.

According to the present invention, a plurality of plane sheet rings are punched from a metal plane sheet, and pressed to form ducts, which are welded to base boards made of metal sheets to manufacture a heat exchanger. The heat exchanger is mounted on a hollow rotor by simple automatic steps. Thus, the ducts of eccentric arcuate shape with respect to the center of the rotor can sufficiently agitate and feed materials with the entire base boards as rotary locus, thereby feeding heating and cooling medium from the ducts at the peripheral edge in the base boards to the ducts at the outer peripheral edge, then through the ducts of inner peripheral edge, sequentially passing the materials through the front and back side ducts of the base boards, and recovering the materials to the hollow ducts, and providing excellent thermal efficiency and thermal transmission efficiency.

BEST MODE FOR CARRYING OUT THE INVENTION

The present invention will be described in detail with reference to embodiments shown in the accompanying drawings.

Figure 1:
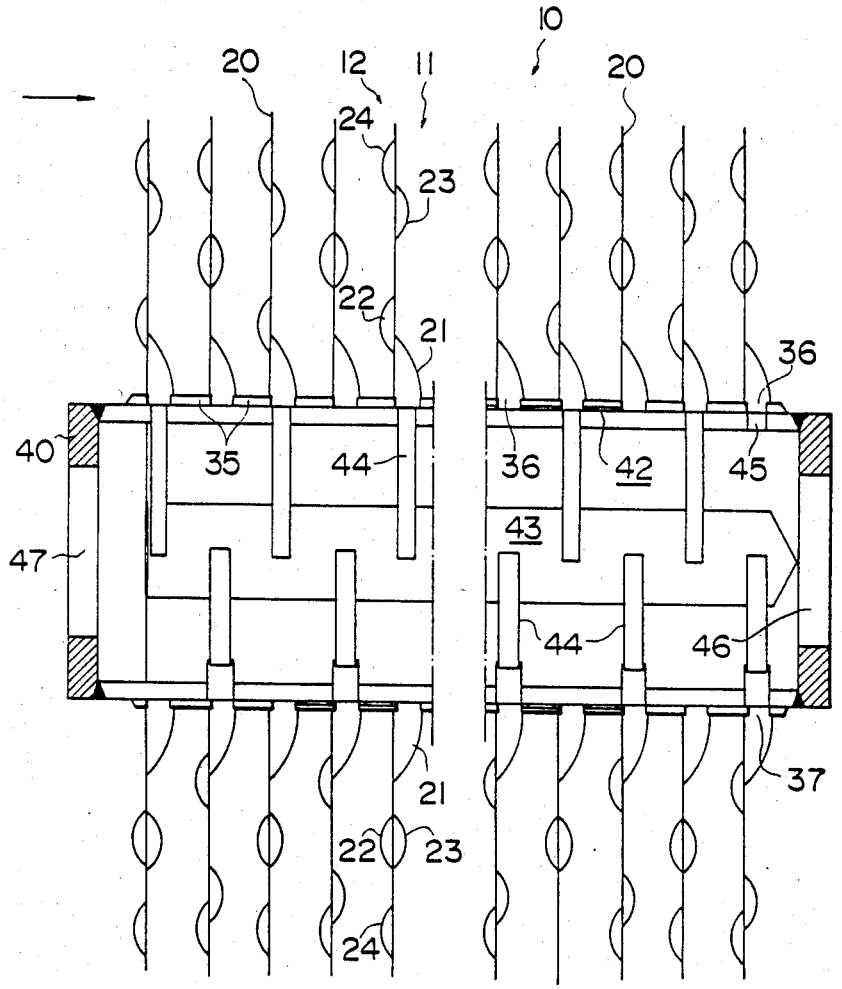
FIG. 1 is a schematic central cross sectional view showing the entirety in a housing in which a heat exchanger constructed according to the present invention is mounted.

FIG. 1 is a partial cross sectional view showing a drying machine as a heat exchanger. A heat exchanger 10 is mounted perpendicularly to an axis on the outer periphery of a hollow rotor 40 through a predetermined interval in a rotor, not shown, having an inlet and an outlet for a material, and rotatably supported together with the rotor 40 via a drive mechanism in the housing.

The heat exchanger 10 has base boards 20, and four ducts 21, 23 and 22, 24 projected on both front sides 11 and backs 12 of the base boards 20 in arcuate cross sectional shape and in circularly plane shape in such a manner that the ducts 21 formed at the inner peripheral edge communicate with an inlet of heating medium of a hollow rotor 40 and an outlet of the medium and/or its condensate and the ducts sequentially communicate with each other.

The hollow rotor 40 is mounted with a hollow shaft 41 for dividing the interior into two chambers, a primary chamber 42 is formed between the outer periphery of the shaft 41 and the inner wall of the rotor 40 to communicate with an inlet 46 of heating and cooling medium, provided at one end of the rotor 40, and a secondary chamber 43 is formed to communicate with an outlet 47 of heating and cooling medium or its condensate, provided at the other end of the rotor 40 in the hollow shaft 41 opened at one end. Conduits 44 which communicate with the ducts 21 having outlets of the heating medium or its condensate of the heat exchanger 10 to be described in more detail later are inserted in the outer periphery of the shaft 41,.and project at one end into the secondary chambers 43 of the shaft 41.

Reference numeral 45 designates an inlet for heating and cooling medium, communicating with the duct 21 for forming the heat exchanger 10, and formed of openings perforated at the outer periphery of the rotor 40.

In FIG. 1, arrows indicate the feeding direction of the materials. Reference numeral 35 designates a ring-shaped reinforcing member, when the heat exchanger !0 is welded fixedly to the rotor 40, the inner peripheral edge of the base board 20 and one side inner peripheral edge of the duct 21 are fixed, and an opening 36 communicating with the inlet 45 of the heating medium and an opening 37 formed near a conduit 44 which forms an outlet are provided at suitable positions.

FIGS. 2 to 6 show the details of the heat exchanger 10. As apparent from FIGS. 2 and 3, the base board 20 of metallic disc shape is a doughnut-shaped flat disk having a hole 25 removably mounted on the outer periphery of the rotor, is, for example, formed of a metal sheet such as a stainless steel sheet, is readily manufactured by punching by a press, and fixed at the inner peripheral edge to the outer periphery of the reinforcing member 35.

The ducts 21 to 24 are all formed in arcuate cross sectional shape of less than a semicircular shape to be readily molded, and simultaneously punched and pressed in a doughnut shape from a metallic shape having substantially the same diameter as the base board 20.

More particularly, the duct 21 is formed concentrically with the base board 20, welded fixedly at one side edge to the reinforcing member 35 and at the other side edge to the surface 11 of the base board 20, thereby forming a passage between the base board 20 and the outer periphery of the member 35 in such a manner that the outer diameter of the duct 21 is equal to the inner diameter of the duct 22. Further, the ducts 22 to 24 are secured fixedly by welding at the arcuate edges to the board 20 to form passages. The duct 22 is provided on the back side of the board 20 at the beforehand side of the paper plane in FIG. 2 in such a manner that the center is disposed displaced from the center of the board 20 slightly rightward on the horizontal diameter in FIG. 2, and the duct 22 is accordingly superposed through the board 20 in the leftward on the diameter from the duct 21 in FIG. 2 in such a manner that the outer diameter of the duct 22 is equal to the inner diameter of the duct 23. The duct 23 is provided on the front side of the board 20 in such a manner that the center is displaced slightly leftward from the center of the board 20. Therefore, the duct 23 is superposed.on the duct 22 through the board 20 in the rightward on the diameter in FIG. 2. Then, the duct 23 is so arranged as to be superposed with the duct 24 having an inner diameter equal to the outer diameter of the duct 23. In other words, the duct 24 is arranged on the back side of the board 20 in such a manner to be substantially concentrically with the board 20 so that the outer diameter arrives substantially at the outer peripheral edge of the board 30 and is superposed with the duct 23 in the leftward on the diameter in FIG. 2.

Figure 2:
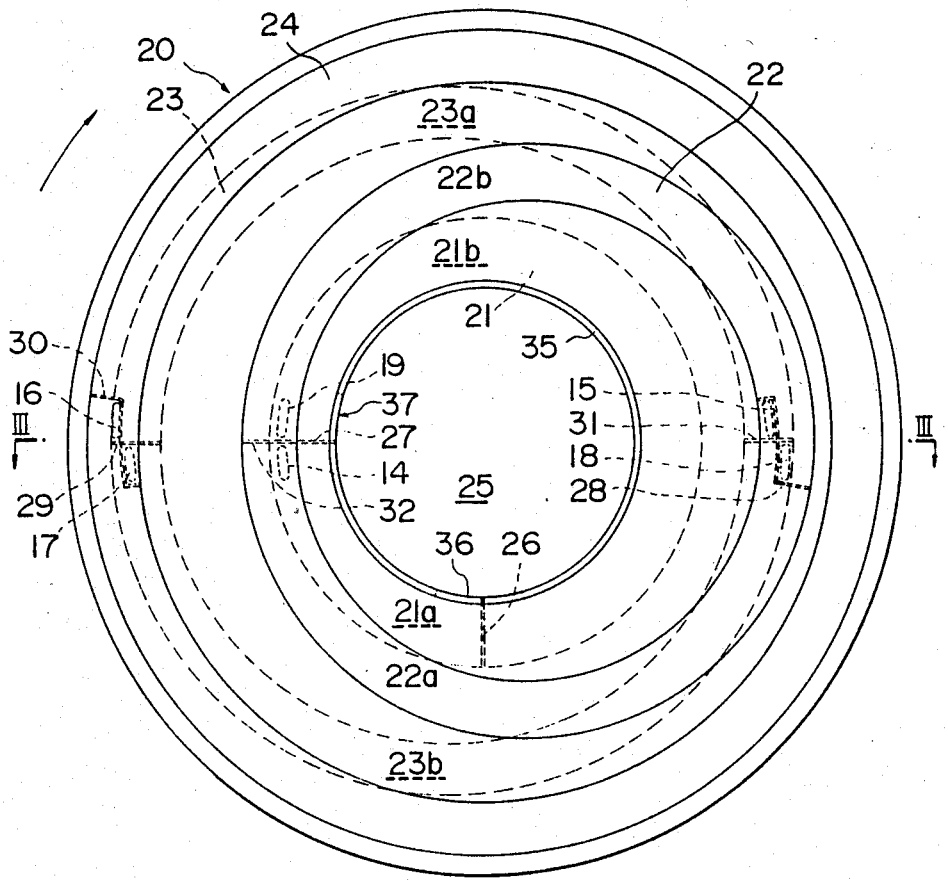
FIG. 2 is a plan view showing the entirety of the heat exchanger.
Figure 3:
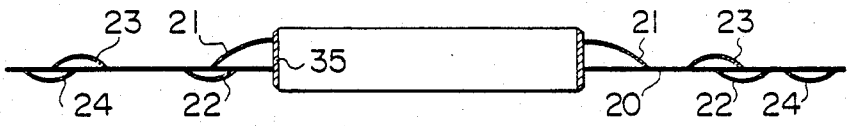
FIG. 3 is a sectional view, taken along the line III—III in FIG. 2.

In FIG. 2, reference numerals 26 to 32 designate partition plates, and 14 to 19 designate inserting holes.

Figure 5:
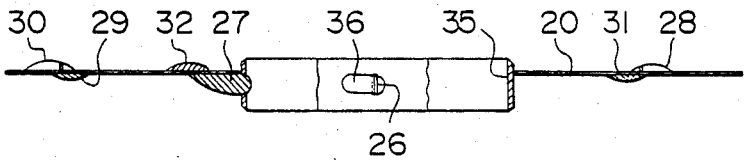
FIG. 5 is a schematic cross sectional view along the line V—V in FIG. 4 showing a partition plate.
Figure 6:
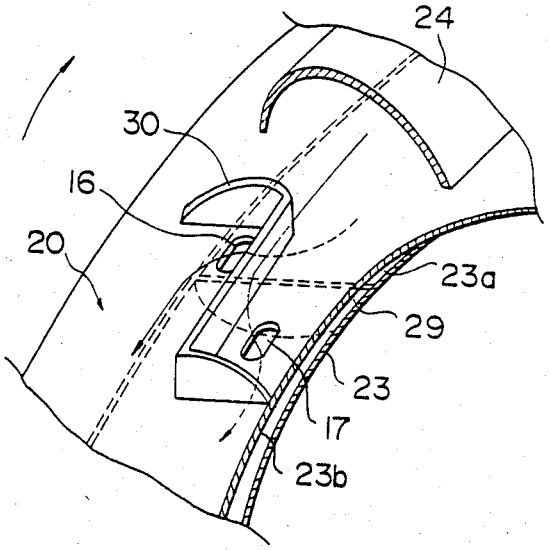
FIG. 6 is a fragmentary cross sectional view showing the superposed portion of ducts 23 and 24.
Figure 4:
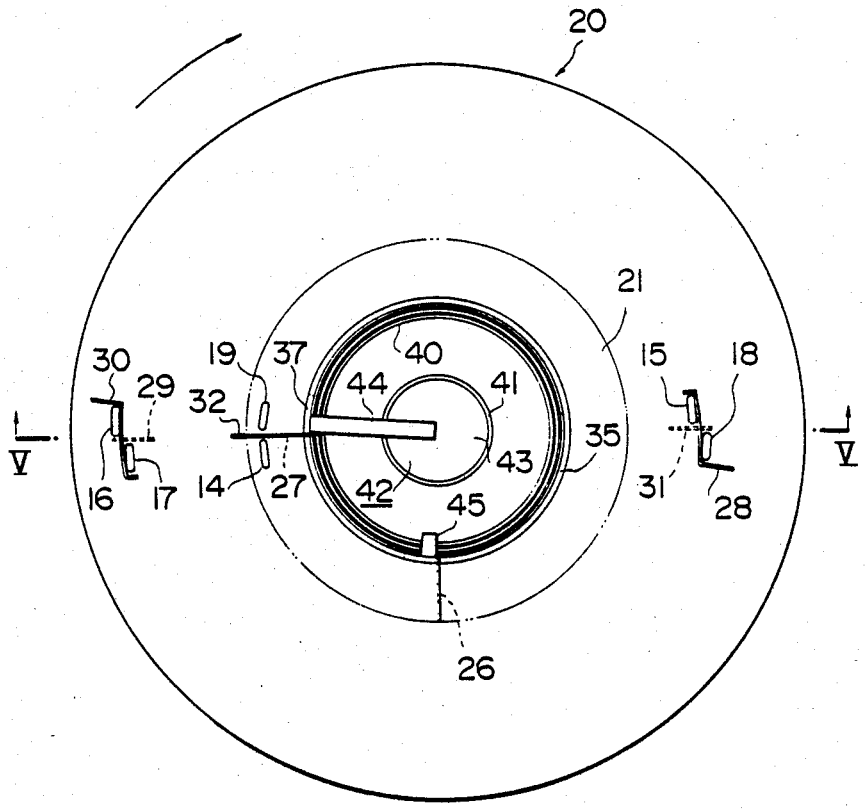
FIG. 4 is a plan view of the base of the state that the duct is removed.

FIGS. 4 to 6 clarify the dispositions of the partition plates 26 to 31 and the inserting holes 14 to 19. The partition plates 26 to 31 have the shape of the upper side corresponding to the sectional shape of the disposed ducts and the shape of the lower side in a rectilinear line. The partition plates 26, 27 are mounted on the board 20 to face the openings 36, 37 to shield the duct 21, thereby dividing the duct into two chambers in such a manner that the heating medium is supplied from the inlet 45 formed at the rotor 40 into the primary chamber which occupies substantially $\frac{1}{4}$ of the duct 21 between the partition plates 26 and 27. The partition plate 32 is formed in a crescent cutout arcuate shape, and mounted substantially rectilinearly in FIG. 4 of the partition plate 27 in the superposed portion with the duct 21 in the duct 22. The duct 22 is divided by the superposed portion with the duct 21, and the partition plate 28 is also provided on the diameter in the rightward in FIG. 4. The partition plate 28 is formed of the curved portion corresponding to the arcuate of the duct 22 and the rectilinear portion extended substantially perpendicularly from the end of the curved portion. The two chambers of the duct 21 and the inserting holes 14, 19 communicating with the two chambers are perforated at the board 20 at the opposed positions through the partition plates 27, 32, the inserting holes 15, 18 are perforated at the board 20 at the opposed positions through the partition plate 28 and a partition 31 to be described later along the curved portion of the partition plate 28 to communicate with the two chambers of the duct 23. The partition plates 29, 31 of the duct 23 are provided on the diameter of the board 20 in the cutout arcuate shape. The partition plate 29 is provided on the superposed portion with the duct 24, and the partition plate 31 is provided on the superposed portion with the duct 22. The partition plate 30 of the duct 24 is formed of a curved portion and a rectilinear portion in the same manner as the partition plate 28, arranged on the partition plate 29 in the duct 23, and inserting holes 16, 17 communicating with the ducts 23 divided into two chambers through the partition plates 29, 30 are formed at the board 20.

A plurality of the base boards 20 thus constructed as described above are welded fixedly to the outer periphery of the hollow rotor 40 through a suitable interval in the direction perpendicular to the axis while adequately varying at the positions of the openings 36, 37, thereby constructing a heat exchanger 10 (FIG. 1).

In the embodiment described above, the flow of the heating medium or the heating medium and its condensate and the operation of the medium will be described.

In FIG. 1, the heating medium such as, for example, steam is supplied from the inlet 46 provided at the end of the hollow rotor 40 to the primary chamber 42 of the rotor 40 under a predetermined pressure, and a material is filled from the left side of FIG. 1 (as designated by arrows). The steam is fed from the inlet 45 perforated at the outer periphery of the rotor 40 to the ducts 21 of the boards 20 through the openings 36.

In FIG. 2, the base board 20 is rotated clockwisely in FIG. 2. The steam supplied to the primary chamber **21*a* of the duct 21 at the rear side of the paper plane from the opening 36 is fed from the partition plate 26 to the partition plate 27, and fed from the inserting hole 14 to the primary chamber 22*a* of the duct 22 superposed with the duct 21 at the front side of the paper plane. The steam is fed by the partition plate 32 of the duct 22 to the partition plate 28, fed into the primary chamber 23*a* of the duct 23 at the rear side of the paper plane to be superposed with the superposed portion through the inserting hole 15, arrives at the partition plate 29 in the leftward in FIG. 2 by the partition plate 31, and supplied, as shown in FIG. 6 to the duct 24 at the front side of the paper plane to be superposed with the partition plate 29 through the inserting hole 16. The partition plate 30 is provided in the duct 24, the steam is again circulated in the duct 24, and fed to the partition plate 30, and then supplied to the secondary chamber 23*b* shielded by the partition plate 29 of the duct 23. The steam supplied to the secondary chamber 23*b* is fed to the partition plate 31 in the duct 23, and fed to the secondary chamber 22*b* shielded by the partition plate 28 in the duct 22 through the inserting hole 18 in the superposed portion. Subsequently, the steam is fed to the partition plate 32 of the duct 22, recovered together with the condensate with the secondary chamber 21*b* for forming a drain reservoir of the duct 21 communicating through the inserting hole 19, passed via the conduit 44 through the opening 37 of the reinforcing member 35, fed to the secondary chamber 43 fored with the hollow shaft 41 in the hollow rotor 40, and recovered externally through the outlet 47**.

The flow of the steam in the meantime is, in FIG. 2, from the back side duct 31a, through the front duct **22*a*, the back duct 23*a*, the front duct 24, the back duct 23*b*, the front duct 22*b* to the back duct 21*b***.

In other words, the heating medium is fed uniformly to the entire board in the direction to the material to be agitated in opposite direction by the rotation of the board, thereby sufficiently thermally exchanging with the material.

INDUSTRIAL APPLICABILITY

As described above according to the present invention, since the heat exchanger comprises a hollow rotor having an inlet of heating and cooling medium and an outlet of the medium or its condensate, a casing mounted on the hollow rotor, a plurality of disc-shaped base boards, a plurality of annular ducts projected from both side surfaces of the base boards, said duct forming a passage communicating with the inlet and the outlet, arranged so as to be partly superposed sequentially on both front and back surfaces of the base board from the inner peripheral edges to the outer peripheral edges of the base boards in such a manner that partition plates for shielding the ducts being provided in the superposed positions in the ducts and inserting holes communicating between the front side and back side ducts being perforated at the base boards through the partition plates, all the manufacturing steps can be substantially automated, the thermal exchanging area per unit housing volume can be increased by the disc-shaped base board, the treating capacity can be increased, arcuate-shaped ducts can be projected from both side surfaces of the boards, the base boards are formed flatly to increase the effective area for containing the material, the adherence of scale can be reduced, thermal conductivity and thermal transmission coefficient can be enhanced, efficient heat exchangers can be provided, and the non-thermal transmission portion of the board can be eliminated to prevent the corrosion from occurring from the non-thermal transmission portion. Since the ducts are formed in arcuate shape, the ducts can be readily molded, the yield of the material of the duct can be improved, a structure adapted for an automation can be provided to reduce the manufacturing cost. Further, since the arcuate-shaped ducts are sequentially superposed partly at the front and back sides of the boards to communicate with each other through the inserting holes, the materials can be sufficiently agitated and reliably fed. Even if the material is moist and tacky such as organic material, the material can be effectively agitated and fed, no scale is adhered to the surfaces of the boards and the ducts, the materials do not retain between the boards, the materials can be prevented from being locally heated, thereby efficiently thermally exchanging the material, the organic material which is unsuitable for drying at high temperature can be dried at low temperature in a short time, the remaining air and noncompressive gas and drain (condensate) in the ducts can be readily recovered, and do not retain in the ducts. Since the supply and recovery of the heating and cooling medium are in opposite direction to the rotating direction of the boards in one-way passage to smoothly flow oppositely to the material without unreasonable force, thereby providing preferable thermal transmission.

What is claimed is:

1. A heat exchanger comprising a hollow rotor having an inlet of heating and cooling medium and an outlet of the medium or its condensate, a casing mounted on the hollow rotor, a plurality of disc-shaped base boards, a plurality of annular ducts projected from both side surfaces of the base boards, said duct forming a passage communicating with the inlet and the outlet, arranged so as to be partly superposed sequentially on both front and back surfaces of the base board from the inner peripheral edges to the outer peripheral edges of the base boards in such a manner that partition plates for shielding the ducts being provided in the superposed positions in the ducts and inserting holes communicating between the front side and back side ducts being perforated at the base boards through the partition plates.

2. The heat exchanger as claimed in claim 1 wherein said ducts are formed in cutout arcuate cross sectional shape.

3. The heat exchanger as claimed in claim 1 wherein said base boards are welded fixedly to the outer periphery of said hollow rotor through reinforcing members.

4. The heat exchanger as claimed in claim 3 wherein the duct at the inner peripheral edge of said board is welded fixedly at one side edge to said board and at the other side edge to a reinforcing member.

5. The heat exchanger as claimed in claim 1 wherein said ducts are formed by two each on the front and back sides of said boards, arranged sequentially from the inner peripheral edges to the outer peripheral edges of said boards at both the front and back sides of said boards in such a manner that the outer diameter of one duct is equal to the inner diameter of next duct.

6. The heat exchanger as claimed in claim 1 wherein the duct at the inner peripheral edge of said board is concentrically with said board and is formed with two chambers communicating with the inlet of the heating and cooling medium of said hollow rotor and the outlet of the medium or the condensate through two openings perforated at the outer periphery of said hollow rotor.

7. The heat exchanger as claimed in claim 6 wherein two openings perforated at said rotor face the primary chamber of the duct at the inner peripheral edge of said board and the secondary chamber of said cut faces one end of said conduit.

8. The heat exchanger as claimed in claim 1 wherein said duct arranged at the inner peripheral edge of said board is formed of the primary chamber partition in $\frac{1}{4}$ of a circuit through two partition plates and the remaining secondary chamber.

9. The heat exchanger as claimed in claim 1 wherein said duct disposed at the outer peripheral edge of said board has a partition plate, is formed of a chamber concentric with said board, sequentially superposed with said ducts, the other duct to be superposed with the duct at the inner peripheral edge of said board has two partition plates for dividing said duct into two chambers.

10. The heat exchanger as claimed in claim 1 wherein said ducts disposed between the ducts disposed at the inner and outer peripheral edges of said board are displaced oppositely on the diameter through the center of said board.

11. The heat exchanger as claimed in claim 1 wherein said rotor has a hollow shaft therein, and the interior of said rotor is divided into two chambers.

12. The heat exchanger as claimed in claim 6 or 11 wherein said hollow shaft communicates with the outlet of the heating and cooling medium or its condensate of said rotor, one end thereof faces the cut at the inner peripheral edge of said board at the hollow shaft, and the other end thereof is inserted with a conduit facing the interior of said hollow shaft.

13. A heat exchanger comprising a hollow rotor having an inlet for a heat exchange medium and an outlet for the heat exchange medium;

at least one disc-shaped base board mounted on said rotor;

a plurality of concentric annular ducts mounted on opposite sides of said base board in partially overlapping relation;

at least one pair of partitions disposed in each duct in circumferentially spaced relation to divide said duct into a primary chamber and a secondary chamber;

an inlet opening in said rotor communicating said rotor inlet with said primary chamber of an innermost duct to deliver the heat exchange medium thereto;

an outlet opening in said rotor communicating said secondary chamber of said innermost duct with said rotor outlet to exhaust heat exchange medium therethrough; and a plurality of openings in said base board, each said opening communicating one chamber of one duct with one chamber of an overlapping duct to define a flow path of the heat exchange medium from said primary chamber of said innermost duct sequentially through said primary chambers of the remaining ducts and then through said secondary chambers of said remaining ducts to said secondary chamber of said innermost duct.

14. A heat exchanger as set forth in claim 13 wherein each said duct is of arcuate cross-sectional shape.

15. A heat exchanger as set forth in claim 13 wherein said innermost duct is coaxial of said rotor.

16. A heat exchanger as set forth in claim 13 which further comprises a hollow shaft coaxially within said rotor and having a closed end and an open end to define a secondary chamber therein, said rotor inlet communcating with an annular space between said shaft and said rotor and said rotor outlet communicating with said secondary chamber of said shaft and said inlet opening of said rotor communcating said annular chamber with said primary chamber of said innermost duct and a conduit in said outlet opening of said rotor communicating said secondary chamber of said innermost duct with said secondary chamber of said shaft.

17. A base board for a heat exchanger comprising a disc-shaped base board;

a plurality of concentric annular ducts mounted in alternating manner on opposite sides of said base board and in partially overlapping relation;

at least one pair of partitions in each duct to divide said duct into a primary chamber and a second chamber; and a plurality of openings in said base board, each said opening communicating one chamber of one duct with one chamber of an overlapping duct to define a flow path for a heat exchange medium sequentially through said primary chambers of ducts and then sequentially through said second chambers of said ducts.

18. A base board as set forth in claim 17 wherein the innermost duct is coaxial of said board.

* * * * *